US006595655B2

(12) United States Patent
Neeb

(10) Patent No.: US 6,595,655 B2
(45) Date of Patent: Jul. 22, 2003

(54) MECHANICAL DART CARRIER

(76) Inventor: Robert Neeb, N85 W16161 Donald Ct., Menomonee Falls, WI (US) 53051

( * ) Notice: Subject to any disclaimer, the term of this patent is extended or adjusted under 35 U.S.C. 154(b) by 12 days.

(21) Appl. No.: 09/977,608

(22) Filed: Oct. 15, 2001

(65) Prior Publication Data

US 2003/0072148 A1 Apr. 17, 2003

(51) Int. Cl.[7] ..... B65D 85/00
(52) U.S. Cl. ..... 362/154; 206/315.1; 206/315.11
(58) Field of Search ..... 206/315.1, 315.11; 362/154, 155, 156

(56) References Cited

U.S. PATENT DOCUMENTS

| | | | | |
|---|---|---|---|---|
| 1,341,559 A | | 5/1920 | Jackson | |
| 1,397,610 A | | 11/1921 | Appell | |
| 2,252,381 A | | 8/1941 | Ladd | |
| 2,390,631 A | | 12/1945 | Young | |
| 2,504,820 A | | 4/1950 | Forlenza | |
| 3,458,078 A | | 7/1969 | Skidmore | |
| 3,727,748 A | | 4/1973 | Brown | 206/15.1 C |
| 3,904,362 A | | 9/1975 | DiPaolo | 21/87 |
| 3,960,271 A | | 6/1976 | Nelson | 206/315 R |
| 4,697,379 A | | 10/1987 | McPhaul | 43/54.1 |
| 4,714,985 A | | 12/1987 | Hickey | 362/154 |
| 4,765,482 A | | 8/1988 | Delia | 206/555 |
| 4,773,578 A | | 9/1988 | Braun | 224/252 |
| 4,999,943 A | | 3/1991 | Crabtree | 43/54.1 |
| 5,067,610 A | | 11/1991 | Jensen | 206/315.1 |
| 5,165,537 A | | 11/1992 | Neff et al. | 206/315.1 |
| 5,238,108 A | | 8/1993 | Velezis et al. | 206/315.1 |
| 5,359,505 A | | 10/1994 | Story et al. | 362/200 |
| 5,450,992 A | | 9/1995 | Coffee | 224/240 |
| 5,515,249 A | | 5/1996 | Shiao | 362/119 |
| 5,533,625 A | | 7/1996 | Mikkelsen | 206/565 |
| 5,566,823 A | | 10/1996 | Summers | 206/209.1 |
| 5,690,088 A | * | 11/1997 | Ruble | 124/25.7 |
| 5,733,034 A | | 3/1998 | Jan | 362/119 |
| 5,775,314 A | * | 7/1998 | Michael et al. | 124/86 |
| 5,794,771 A | | 8/1998 | Krawec et al. | 206/223 |
| 5,803,069 A | * | 9/1998 | Schreiber | 124/86 |
| 5,868,266 A | | 2/1999 | Nobakht | 220/23.86 |
| 5,894,927 A | | 4/1999 | Bennett | 206/438 |
| 6,053,315 A | | 4/2000 | Yao | 206/372 |
| 6,173,834 B1 | | 1/2001 | Voden et al. | 206/315.1 |
| 6,305,534 B1 | * | 10/2001 | Neal | 206/315.11 |
| 6,390,294 B1 | * | 5/2002 | Fiore, Jr. et al. | 206/315.11 |

OTHER PUBLICATIONS

No. 1299 to Robertson et al., dated Mar. 12, 1983, pp. 1 and 2.

* cited by examiner

*Primary Examiner*—Laura K. Tso
(74) *Attorney, Agent, or Firm*—Ryan Kromholz & Manion, S.C.

(57) ABSTRACT

The present invention includes a dart carrier for carrying darts, dart parts and other items associated with dart throwing. The dart carrier includes a quiver member having storage chambers such as through-bores, re-entrant bores, and recesses, for example. The various storage chambers retain and store assembled darts and accessories. The carrier further includes a plunger or piston to elevate stored items resting on a lifter plate in the housing for easy access. The plunger retracts the lifter plate during storage.

15 Claims, 15 Drawing Sheets

MECHANICAL DART CARRIER

BACKGROUND OF THE INVENTION

This invention relates generally to dart carriers and more specifically to a mechanical dart carrier for holding and transporting darts and related accessories.

Dart throwing is a popular pastime and competitive leisure time sport among amateurs and professionals. Often a dart shooter may wish to carry extra flights and/or tips for replacement during play. Currently, foldable wallet-style carriers are available to house these extra tips and flights. However, this type of carrier presents several drawbacks. First, since flights are stored therein, either as a part of a dart assembly or separately, crush damage to these delicate, relatively flexible parts is possible. Further, the carrier is not impervious to liquid; hence, its contents are susceptible to fluid damage if the carrier is accidentally dropped in water, for example.

The above-mentioned invention offers a solution to these problems while additionally offering several features unique to dart carriers. The mechanical dart carrier of the present invention is preferably cylindrical in shape and includes a quiver member and a protective housing. The quiver member is designed to retain assembled darts and extra tips and flights. A plunger or piston serves to elevate a lifter upon which assembled darts rest. The piston elevates the lifter for access and retracts the lifter when the darts resting thereon are placed in storage position. A return rod is directly connected to the plunger. Downward longitudinal movement of the return rod, while the lifter is in the extended or in use position, returns the lifter to the stored position. The return rod may be of any length, but is preferably of a length to accommodate the length of the dart being stored. The dart carrier preferably includes a cap which, while in place over the quiver member, prevents the return rod and lifter from inadvertent elevation.

The dart carrier may also include other features such as recesses for extra coin storage and internal or external lighting. Further, the case housing and cap are preferably made from anodized aluminum or other durable material that may be additionally personalized by engraving or the like. The quiver member may be made from any corrosive resistant material such as stainless steel or a translucent material such as acrylic plastic.

SUMMARY OF THE INVENTION

In view of the foregoing disadvantages inherent in the known types of dart carriers, the present invention provides a new carrier. The general purpose of the present invention is to provide an improved dart carrier and method, which does not have the disadvantages present in known devices.

More particularly, the present invention provides an enclosure or housing for assembled dart and a number of dart accessories including tips, flights and extra coins, by way of example. The housing may be of any suitable shape, although it is preferred that the housing be cylindrical and have a tubular bore. The items to be stored are retained in a quiver member residing in the tubular bore and extending outwardly from an end of the housing. The quiver member preferably includes specially configured, coextensive through-chambers and circumferentially spaced recesses and re-entrant bores. Assembled darts to be stored may be housed in the through-chambers and suspended on a longitudinally movable lifter located in the housing below the quiver. Additional items may be stored in stationary, circumferentially spaced recesses and re-entrant bores located in the quiver member.

The moveable lifter preferably includes a stem having at its lower end a radially extending lifter plate. The lifter plate is normally spaced below the stationary quiver member and below the items located in the coextensive through-chambers to be supported thereon. The lifter, while in the retracted position, is located a sufficient distance below the quiver member to allow the stored items resting on the lifter plate to be elevated above the top of the quiver member upon longitudinal upward travel of the lifter plate. This action allows access of the stored items when they are elevated by the lifter plate. The lifter plate and stem are captive in the housing. However, when fully elevated, the stem may rise above the upper periphery of the quiver member. A removable cap further protects the contents of the quiver member while not in use.

It is an object of this invention is to provide a dart and accessories carrier which supports and protects delicate dart components during transport.

An additional object of the invention is to provide a dart and accessories carrier with a longitudinally movable supporting lifter plate which allows darts to be enclosed during transport and elevated for use.

Another object of the present invention is to provide a dart and accessories carrier that can be provided with illumination means.

Various other features, objects, and advantages of the present invention will be made apparent from the following detailed description and the drawings.

DESCRIPTION OF THE DRAWINGS

Like elements described and illustrated herein bear like reference numerals.

DETAILED DESCRIPTION

Figure 1:
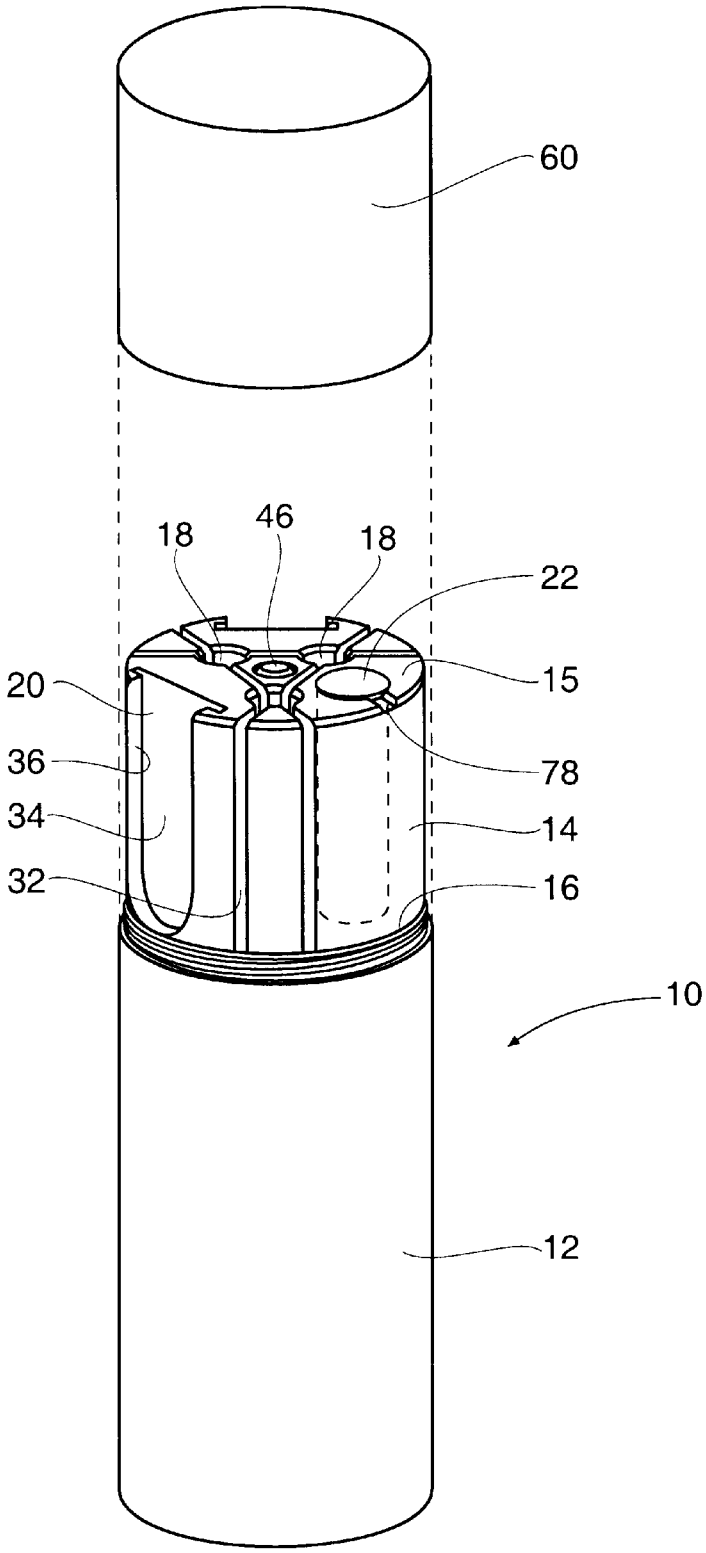
FIG. 1 is an exploded elevational view of a preferred embodiment of the dart carrier.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Referring now to the views of FIGS. 1–4, a preferred embodiment of the dart carrier 10 may be seen. As seen particularly in the view of FIG. 4, the dart carrier 10 includes a housing member 12 and a quiver member 14 attached to one end 16 of the housing member 12. The housing 12 may be of any suitable shape, although it is preferred that the housing 12 be cylindrical. The items to be stored are retained below the top surface 15 of the quiver member 14 in specially configured, coextensive through-chambers 18, circumferentially spaced recesses 20, and re-entrant bores 22.

Figure 2:
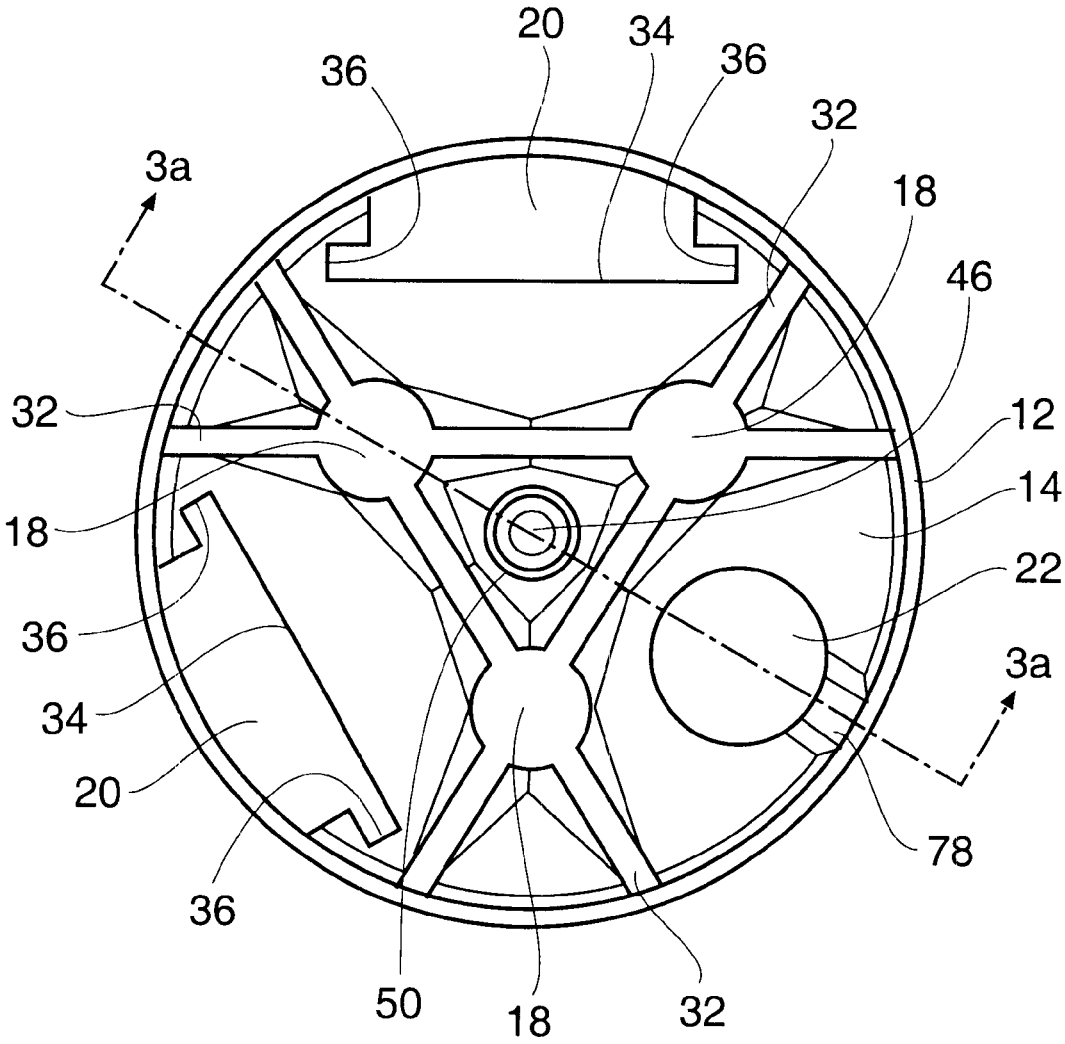
FIG. 2 is a top plan view of the dart carrier shown in FIG. 1 with the top removed.
Figure 3A:
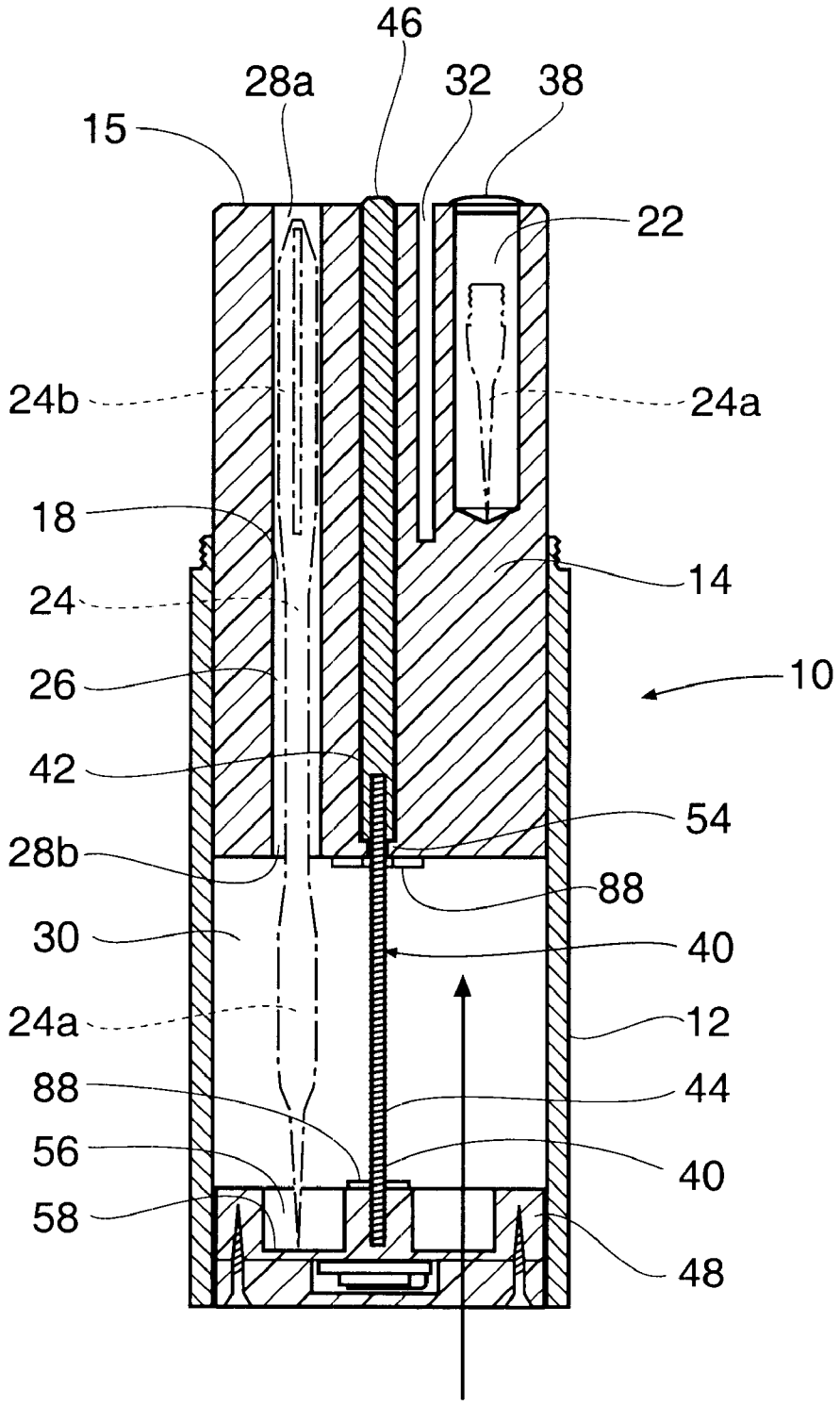
FIG. 3*a* is a longitudinal section of the dart carrier shown in FIGS. 1 and 2 and taken along line 3*a*–3*a* of FIG. 2 showing the lifter plate in retracted, storage position.
Figure 3B:
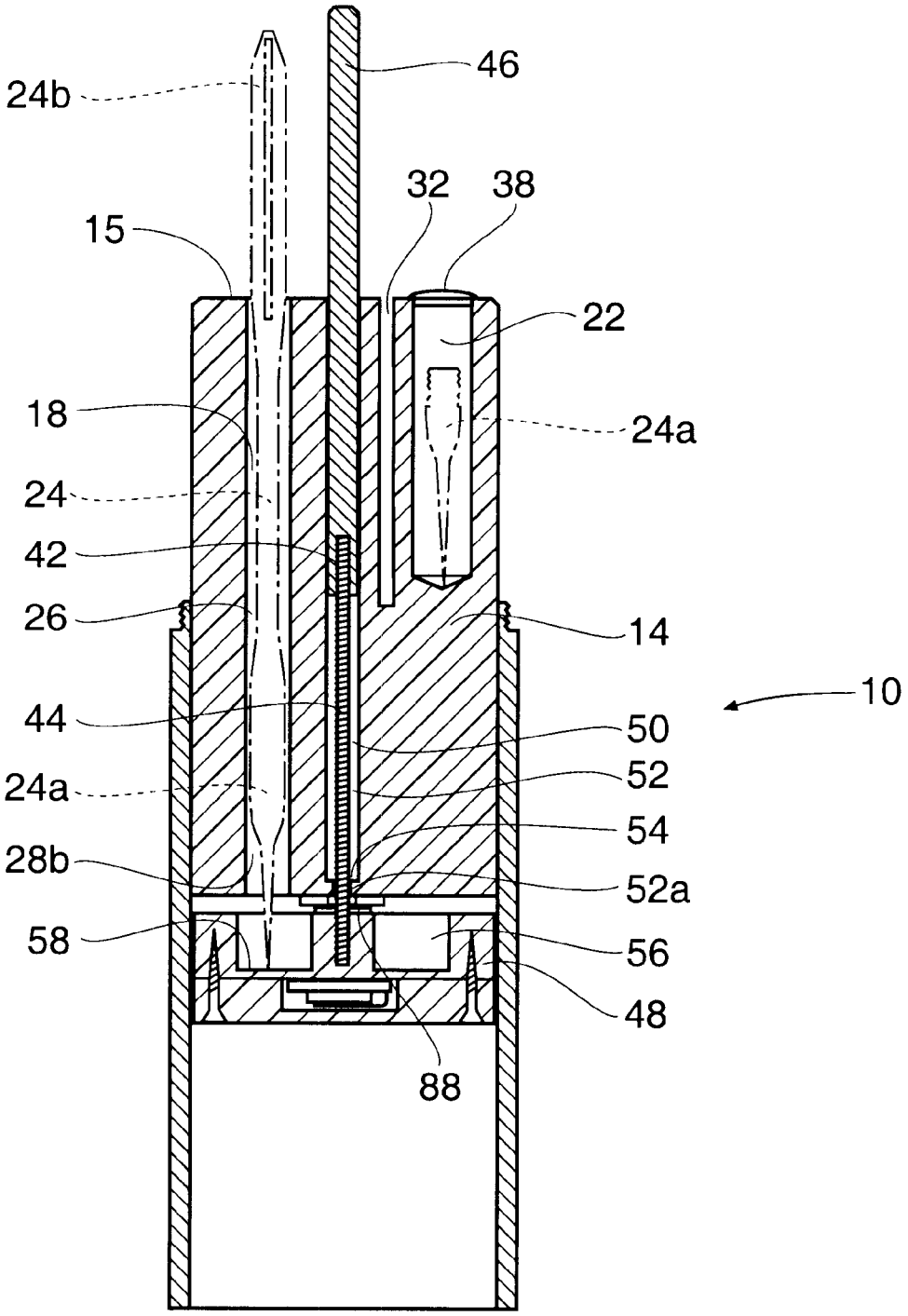
FIG. 3*b* is a longitudinal section similar to the view of FIG. 3*a*, but showing the lifter plate in the extended position.

As may be seen particularly in FIGS. 2, 3*a*, and 3*b*, through-chambers 18 are preferably cylindrical in shape and longitudinally coextensive with the quiver member 14. Assembled darts 24, shown in phantom in FIGS. 3*a* and 3*b*, are slidably received in individual through-chambers 18. The through-chambers 18 include a through bore 26, an open outer end 28*a* and an open inner end 28*b*. Individual assembled darts 24 to be stored in respective through-chambers 18 are preferably inserted tip 24*a* first through open outer end 28*a*. The open inner end 28*b* allows the through-chamber bore 26 to be in communication with the housing bore 30. Through-chambers 18 are preferably further provided with communicating, radially extending slots 32 to provide support and protection for the flights 24*b* of assembled darts 24 stored in the through-chambers 18.

Figure 4:
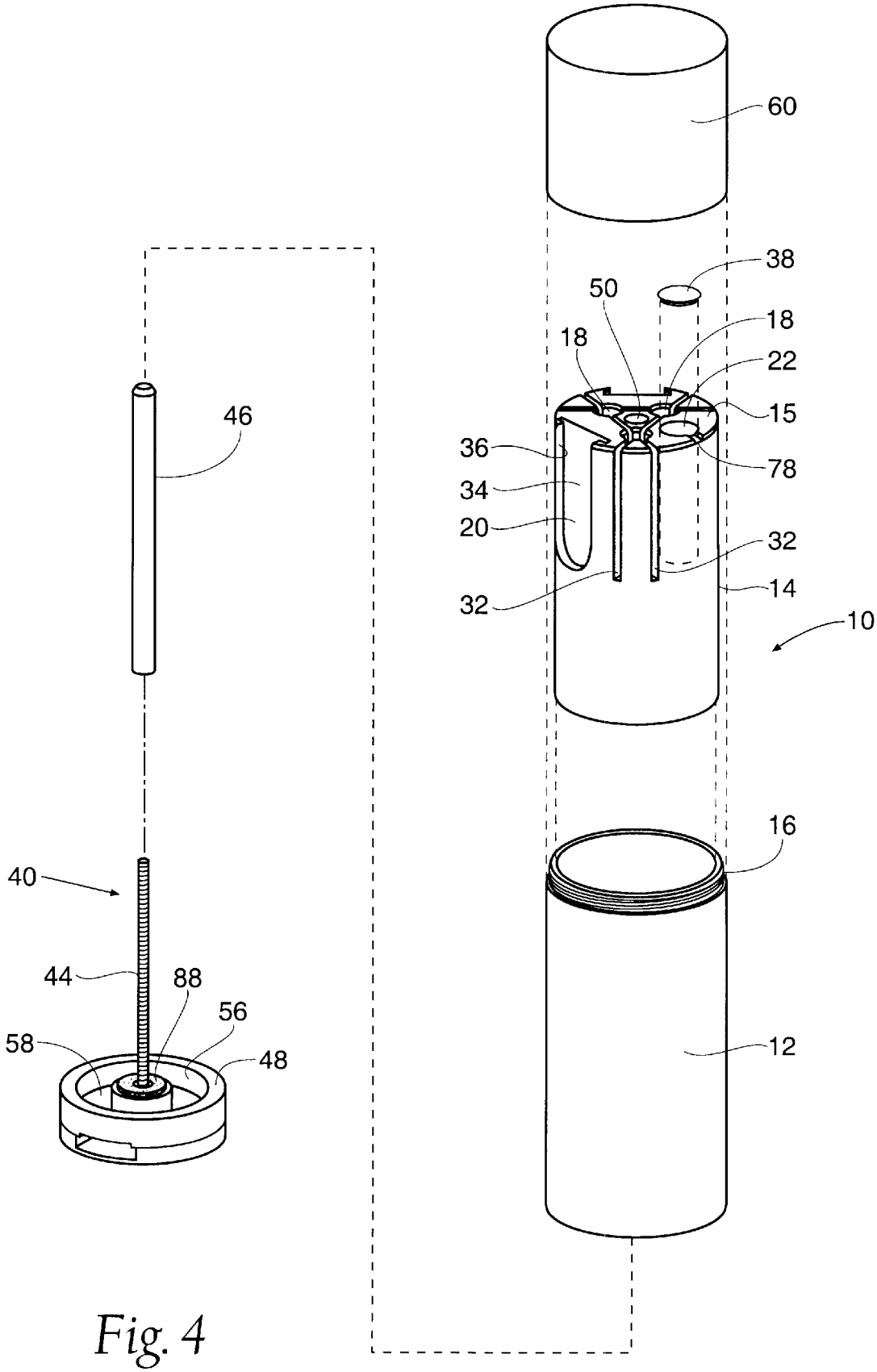
FIG. 4 is an exploded view of the components comprising the dart carrier shown in FIGS. 1–3*b*, inclusive.
Figure 5:
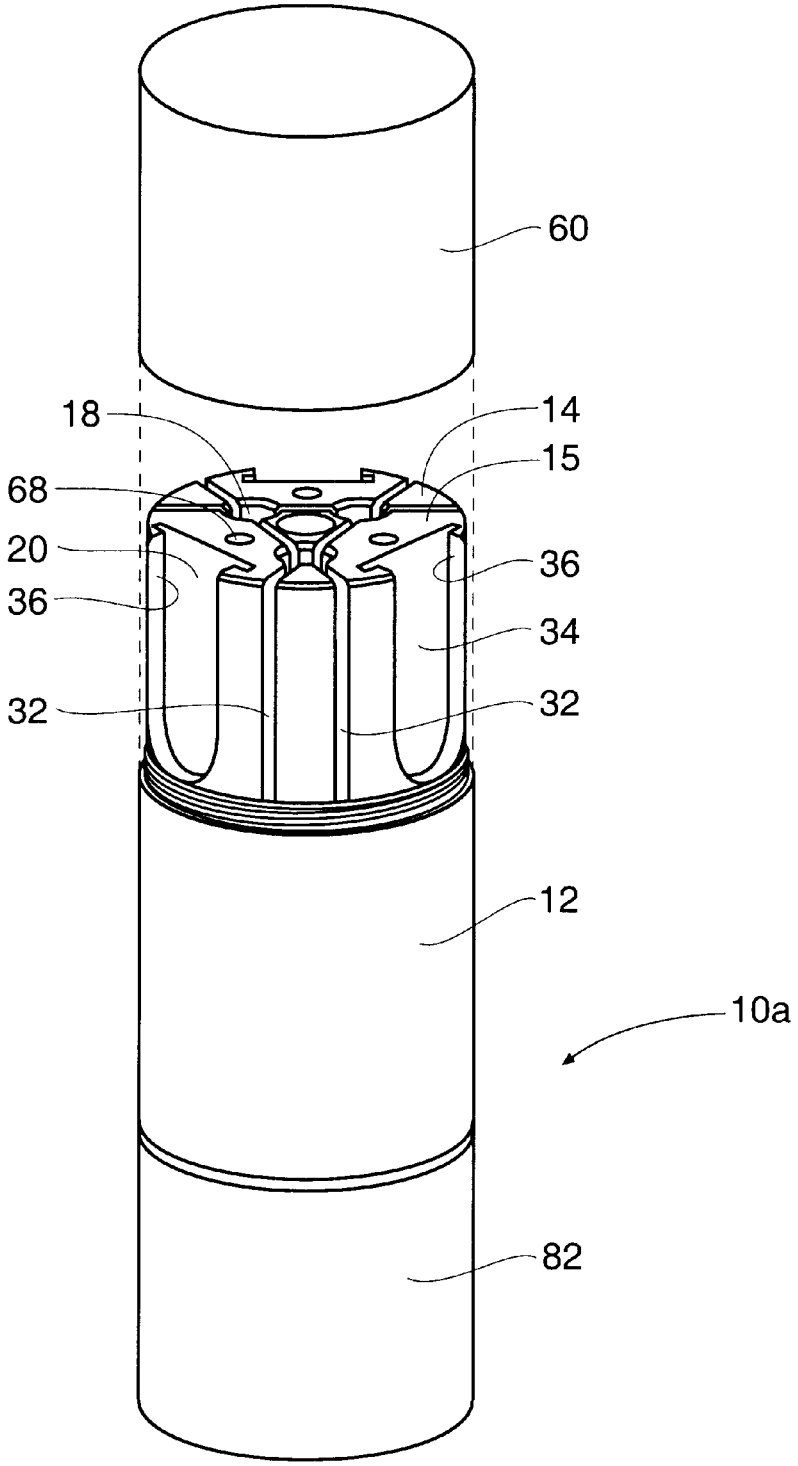
FIG. 5 is an exploded elevational view of an alternative embodiment dart carrier.

As may be seen particularly in FIGS. 1, 2, and 4, additional items, such as extra flights 24*a* or coins (not shown) may be stored in stationary, circumferentially-spaced recesses 20 located on the periphery of the quiver member 14. The recesses 20 preferably include a supporting surface 34 facing the exterior of the quiver member 14 and oppositely disposed, facing grooves 36 defining the width of the recess 20. The configuration of the recesses 20 is adapted to accommodate replaceable flight members 24*a* or coins (not shown).

It is preferred that the quiver member 14 further include at least one re-entrant bore 22 for slidably receiving and storing replacement dart tips 24*a*. The re-entrant bore 22 is preferably circumferentially-spaced and of a sufficient depth to accommodate a dart tip 24*a*. As seen in FIGS. 3*a*, 3*b*, and 4, the re-entrant bore 22 may further include a removable cap 38. The removable cap 38 is easily dislodged from its interference fit in the re-entrant bore 22 by inserting a fingernail (not shown) or other suitable tool in skived area 78 (see FIGS. 1 and 2).

As mentioned above, assembled darts 24 are preferably retained in through-chambers 18 located in the quiver member 14. Since the inner end 28*b* of each through-bore 26 is open and in communication with the hollow bore 30 of the housing 12, darts 24 stored in the through-chambers 18 may enter the hollow housing bore 30. Assembled darts 24 are preferably suspended on a longitudinally movable lifter 40 located in the housing bore 30 below the quiver member 14. As seen in FIGS. 3*a*, 3*b*, and 4, the lifter 40 preferably includes a stem member 42 having a lower end portion 44 and an upper end portion 46. The lower end portion 42 of the stem member 42 includes a radially extending lifter plate 48. The lower end portion 44 of the stem member 42 may be connected to the lifter plate 48 in any feasible manner, however it is preferred that lower end portion 44 be threadably connected to the lifter plate 48.

As may be seen particularly in FIGS. 3*a* and 3*b*, the upper end portion 46 of the stem member 42 is preferably of a greater diameter than the lower end portion 44. The two end portions 44, 46 being threadably connected to one another and slidably received in a stem through-bore 50 located in the quiver member 14. The stem through-bore 50 preferably includes major portion 52 terminating in a minor portion 52*a* at shouldered area 54. The major portion 52 is preferably of a larger diameter than the minor portion 52*a*, the diameters corresponding to the respective diameters of the upper end 46 and lower end 44 of the stem member 42. This arrangement allows the stem member 42 to travel longitudinally within the stem through-bore 50 with the shouldered area 54 acting as a stop for the larger diametered upper end 46 of the stem member. The shouldered area 54 retains the stem member 42 in the stem bore 50 during downward travel to prevent the lifter 40 from escaping the housing bore 30.

The lifter plate 48 is normally spaced below the stationary quiver member 14 and below the items to be stored in the through-chambers 18. A countersunk well area 56 in the supporting surface 58 of the lifter plate 48 allows dart tips 24*a* of assemble darts 24 to be supported thereon.

Referring now particularly to FIGS. 3*a* and 3*b*, movement of the lifter 40 may be seen. The lifter 40, while in the retracted position seen in FIG. 3*a*, is located a sufficient distance below the quiver member 14 to permit the darts 24 to reside below the top surface 15 of quiver member 14. Upon longitudinal upward travel of the lifter 40, seen in FIG. 3*b*, the stored darts 24 resting on supporting surface 58 of countersunk well area 56 of the lifter plate 48 are elevated for access above the top surface 15 of the quiver member 14. Optionally, washers 88 made of hook and loop fastener material may be provided as seen in FIGS. 3*a* and 3*b* to aid in retaining the lifter plate 48 in the elevated position. The lifter plate 48 and stem member 42 are captive in the housing 12, however when fully elevated, the stem member 42 may rise above the upper periphery of the quiver member 14.

A removable cap 60 (seen in FIGS. 1 and 4) further protects the contents of the quiver member 14 while not in use. While the removable cap 60 is in place over the quiver member 14 it also serves to limit travel of the stem member 42 to thereby prevent inadvertent elevation of the stored darts 24.

Referring now to FIGS. 5–8 inclusive, an alternative embodiment dart carrier 10*a* may be seen. As seen in the previous embodiment, the dart carrier 10*a* includes a housing member 12 and a quiver member 14, however as seen here the quiver member 14 is integrally formed with the housing member 12. The housing 12 may be of any suitable shape, although it is preferred that the housing 12 be cylindrical. Similarly to the previous embodiment, the items to be stored are retained below the top surface 15 of the quiver member 14 in specially configured, coextensive through-chambers 18, circumferentially spaced recesses 20, and re-entrant bores 22 (not seen in these views). Although storage areas 18, 20, 22 are preferred, it is to be understood that it is not necessary for the dart carrier to include all storage areas 18, 20, 22. Further, other configurations for storage areas will be apparent to those skilled in the art.

Figure 6:
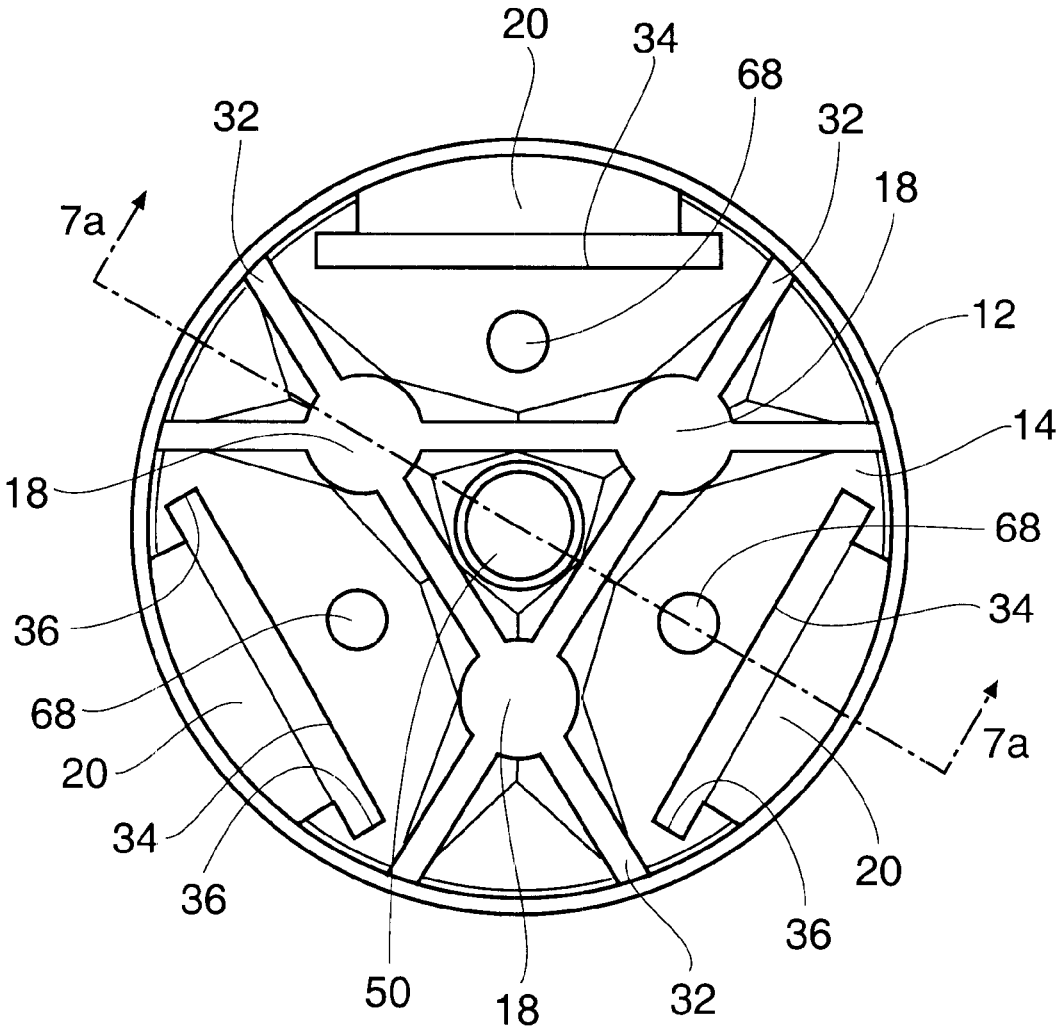
FIG. 6 is a top plan view of the dart carrier shown in FIG. 5 with the top removed.
Figure 7A:
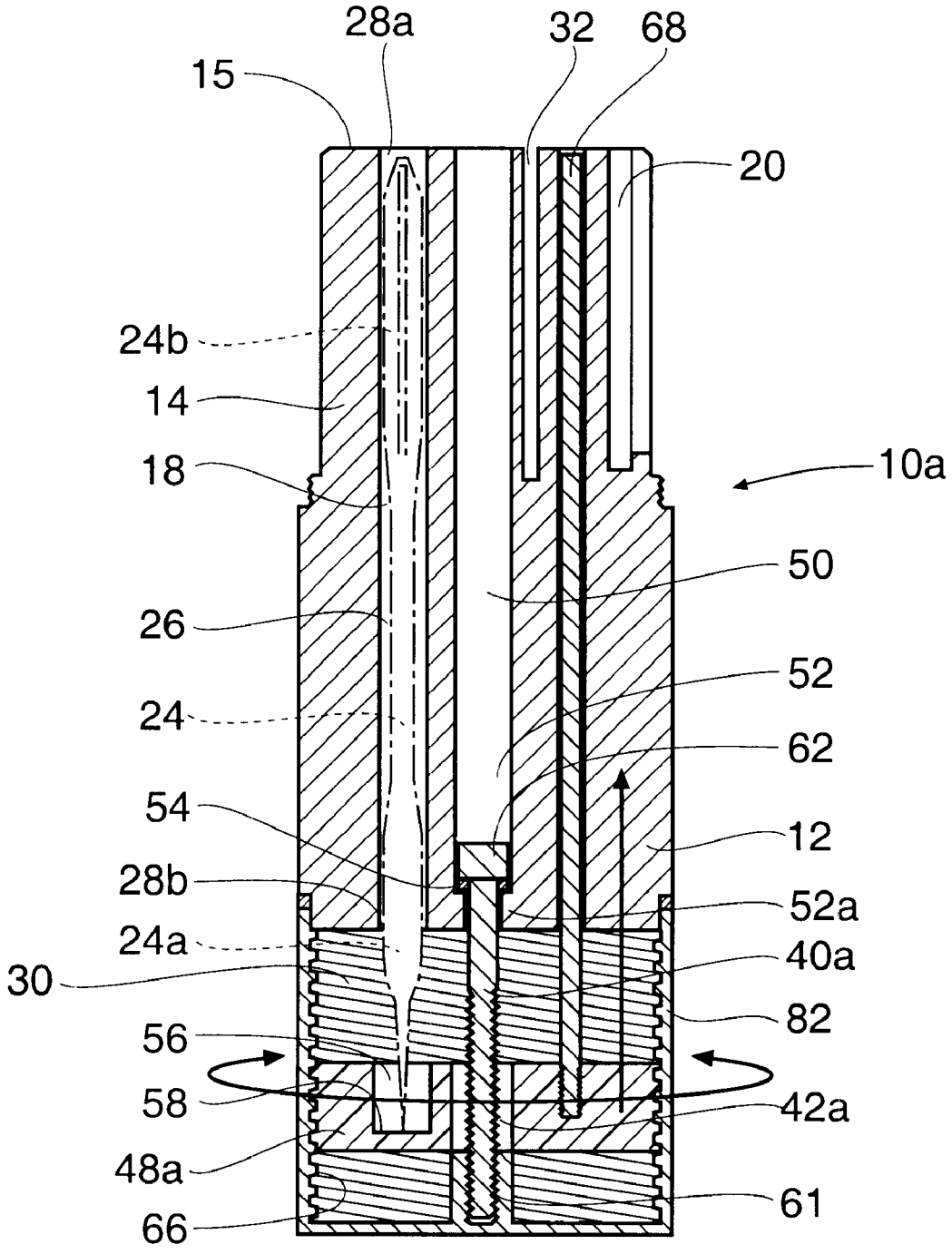
FIG. 7*a* is a longitudinal section of the dart carrier shown in FIGS. 5 and 6 and taken along line 7*a*–7*a* of FIG. 6 and showing an alternative embodiment including an externally threaded lifter plate in retracted, storage position.
Figure 7B:
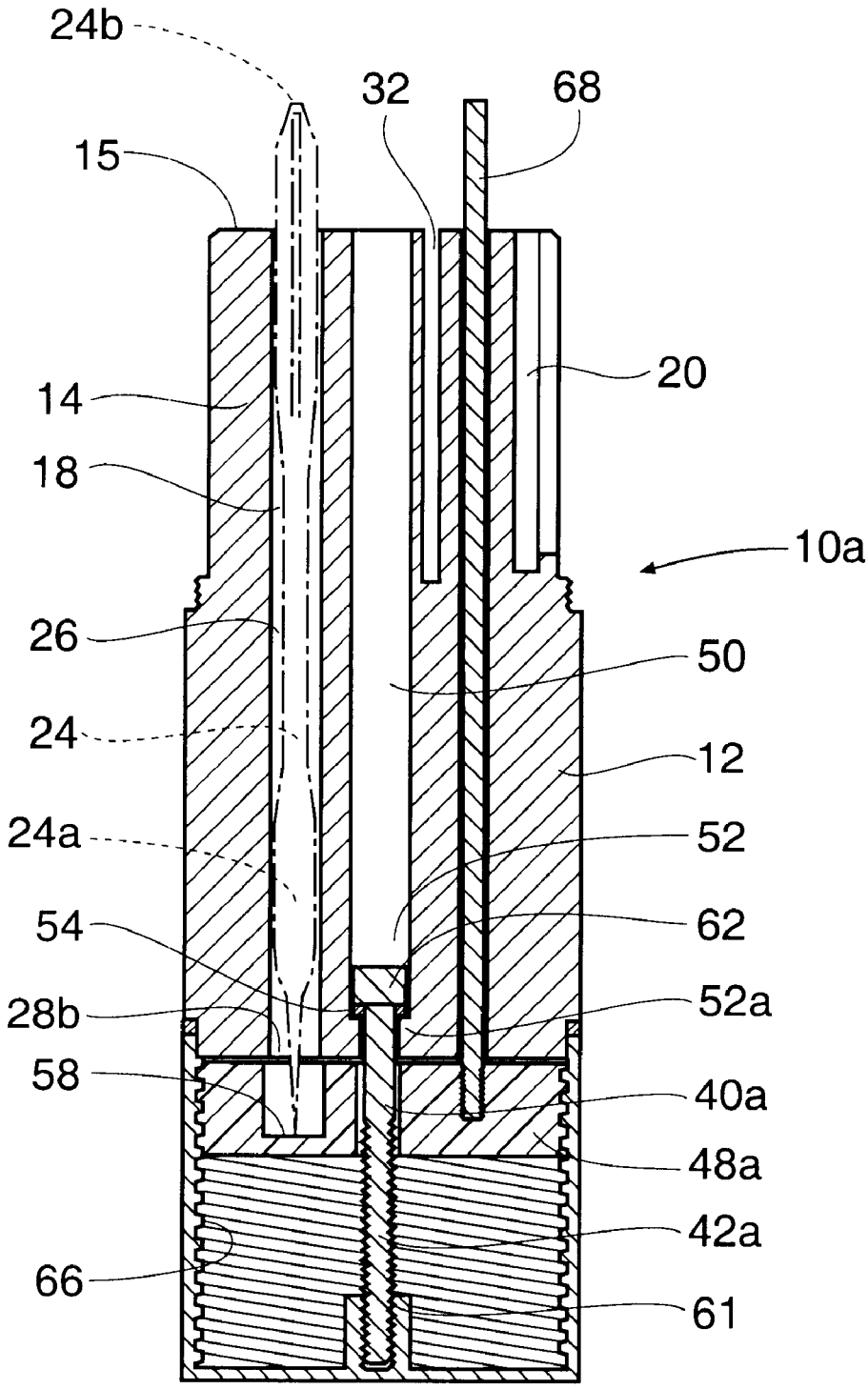
FIG. 7*b* is a longitudinal section similar to the view of FIG. 7*a*, but showing the threaded lifter plate in the extended position.

As may be seen particularly in FIGS. 6, 7*a*, and 7*b*, through-chambers 18 are preferably cylindrical in shape and longitudinally coextensive with the quiver member 14. Assembled darts 24, shown in phantom in FIGS. 7*a* and 7*b*, are slidably received in individual through-chambers 18. As seen in the previous embodiment, the through-chambers 18 include a through bore 26, an open outer end 28*a* and an open inner end 28*b*. Individual assembled darts 24 to be stored in respective through-chambers 18 are inserted tip 24*a* first through open outer end 28*a*. The open inner end 28*b* allows the through-chamber bore 26 to be in communication with the housing bore 30. Through-chambers 18 are preferably further provided with communicating, radially extending slots 32 to provide support and protection for the flights 24*b* of assembled darts 24 stored in the through-chambers 18.

Additional items, such as extra flights 24*a* or coins (not shown) may be stored in stationary, circumferentially-spaced recesses 20 located on the periphery of the quiver member 14. The recesses 20 preferably include a supporting surface 34 facing the exterior of the quiver member 14 and oppositely disposed, facing grooves 36 defining the width of the recess 20. The configuration of the recesses 20 is adapted to accommodate replaceable flight members 24*a* or coins (not shown).

While not shown in the views of FIGS. 5–8, it is to be understood that the quiver member 14 of dart carrier 10*a* may be optionally provided with at least one re-entrant bore 22 similar to those shown in the previous embodiment. The optional re-entrant bore 22 (seen In FIG. 1) slidably receives and stores replacement dart tips 24*a*.

Figure 8:
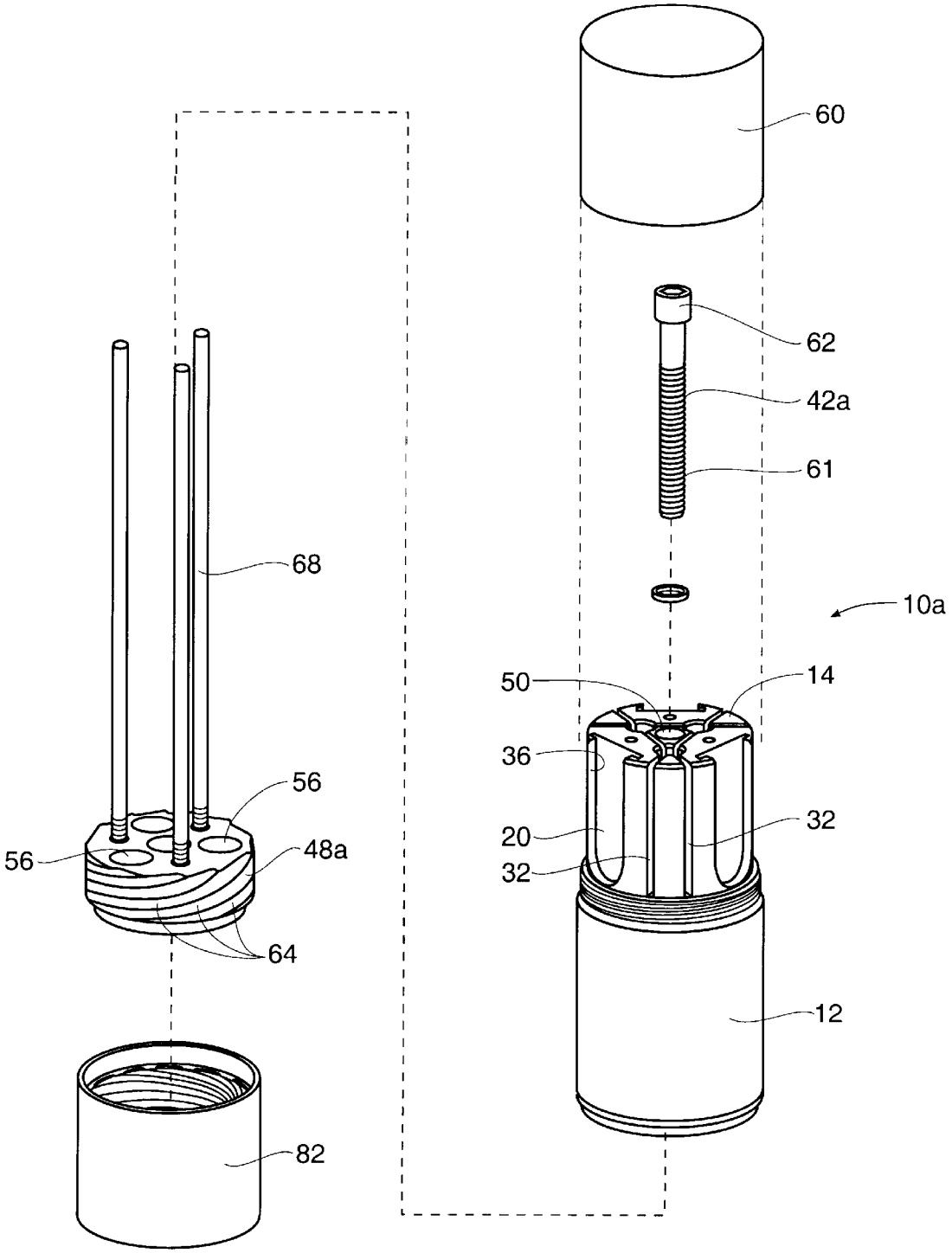
FIG. 8 is an exploded view of the components comprising the dart carrier shown in FIGS. 5–7*b*, inclusive.

As in the previous embodiment, assembled darts 24 are preferably retained in through-chambers 18 located in the quiver member 14. Since the inner end 28*b* of each through-bore 26 is open and in communication with the hollow bore 30 of the housing 12, darts 24 stored in the through-chambers 18 may enter the hollow housing bore 30. Assembled darts 24 are preferably suspended on a longitudinally movable lifter assembly 40*a* located in the housing bore 30 below the quiver member 14. As seen in FIGS. 7*a*, 7*b*, and 8, the lifter assembly 40*a* preferably includes a threaded stem member 42*a*. The stem member 42*a* includes a threaded portion 61 and a socket portion 62. The socket portion is adapted to receive the tip of a conventional allen wrench (not shown) should it be desired to adjust the stem member 42*a*. The threaded stem member 42*a* is threadably connected to a threaded, radially extending lifter plate 48*a*.

As may be seen particularly in FIGS. 7*a* and 7*b*, socket portion 62 the stem member 42*a* is preferably of a greater diameter than the threaded portion 61. The two portions 61, 62 being slidably received in a stem through-bore 50 located in the quiver member 14. The stem through-bore 50 preferably includes major portion 52 terminating in a minor portion 52*a* at shouldered area 54. The major portion 52 is preferably of a larger diameter than the minor portion 52*a*, the diameters corresponding to the respective diameters of portions 61, 62 of the stem member 42*a*. This arrangement seats the socket portion 62 securely in shouldered area 54. The threaded lifter plate 48*a* includes circumferentially spaced threads 64 that are threadingly mated with threads 66 in threaded bore 30*a*.

The threaded lifter plate 48*a* is normally spaced below the stationary quiver member 14 and below the items to be stored in the through-chambers 18. A countersunk well area 56 on the supporting surface 58 of the lifter plate 48*a* allows dart tips 24*a* to be supported thereon.

Referring now particularly to FIGS. 7*a*, 7*b*, movement of the lifter assembly 40*a* may be seen. The lifter assembly 40*a*, while in the retracted position seen in FIG. 7*a*, is located a sufficient distance below the quiver member 14. Upon rotational movement of the base member 82, threaded lifter plate 48*a* and the stored darts 24 resting on the lifter plate 48*a* are elevated for access above the top surface 15 of the quiver member 14. The threaded lifter plate 48*a* and stem member 42 are captive in the housing 12, however when fully elevated, stop rods 68 secured to lifter plate 48*a* may rise above the upper periphery of the quiver member 14. The purpose of the stop rods 68 is to prevent inadvertent elevation of the lifter assembly 40*a* and damage of the items contained in the quiver 14. Upon placement of the removable cap 60 on the quiver member 14, the stop rods 68 are prevented from elevation, thereby also preventing the lifter assembly 40*a* from elevating as well. This feature allows the lifter assembly 40*a* to be elevated only when the cap 60 is removed.

Figure 9:
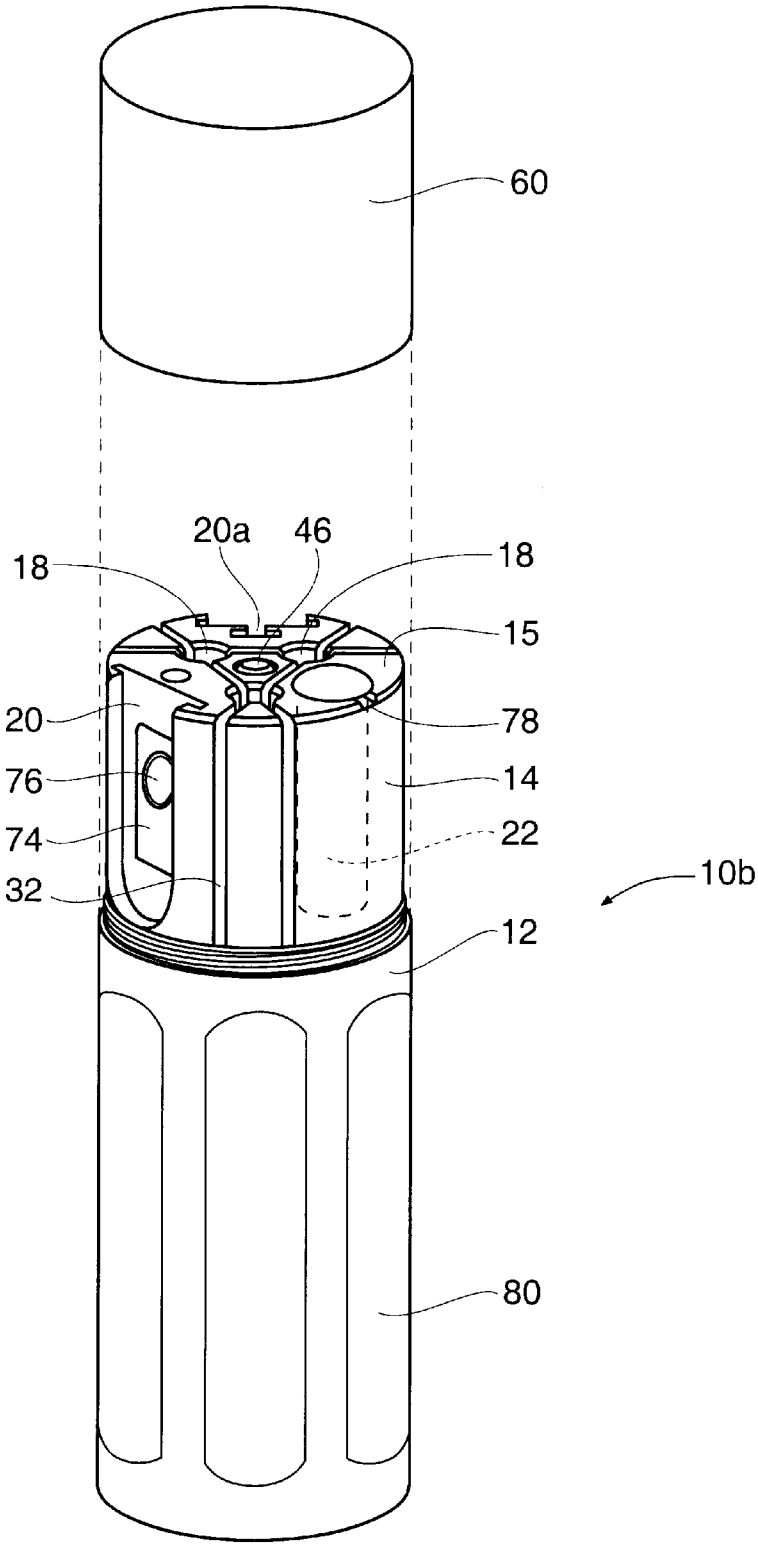
FIG. 9 is an exploded elevational view of another alternative embodiment dart carrier.

Yet another embodiment of the dart carrier may be seen in the views of FIGS. 9–12, inclusive. As seen in the previous embodiments, the dart carrier 10*b* includes a housing member 12 and a quiver member 14 attached to one end 16 of the housing member 12. The housing may be of any suitable shape, although it is preferred that the housing be cylindrical, and as shown in FIG. 9 may include flattened outer surface areas 80. Flattened outer surfaces areas 80 may be engraved, if desired. The items to be stored are retained below the top surface 15 of the quiver member 14 in specially configured, coextensive through-chambers, 18 circumferentially spaced recesses 20, and re-entrant bores 22.

Figure 10:
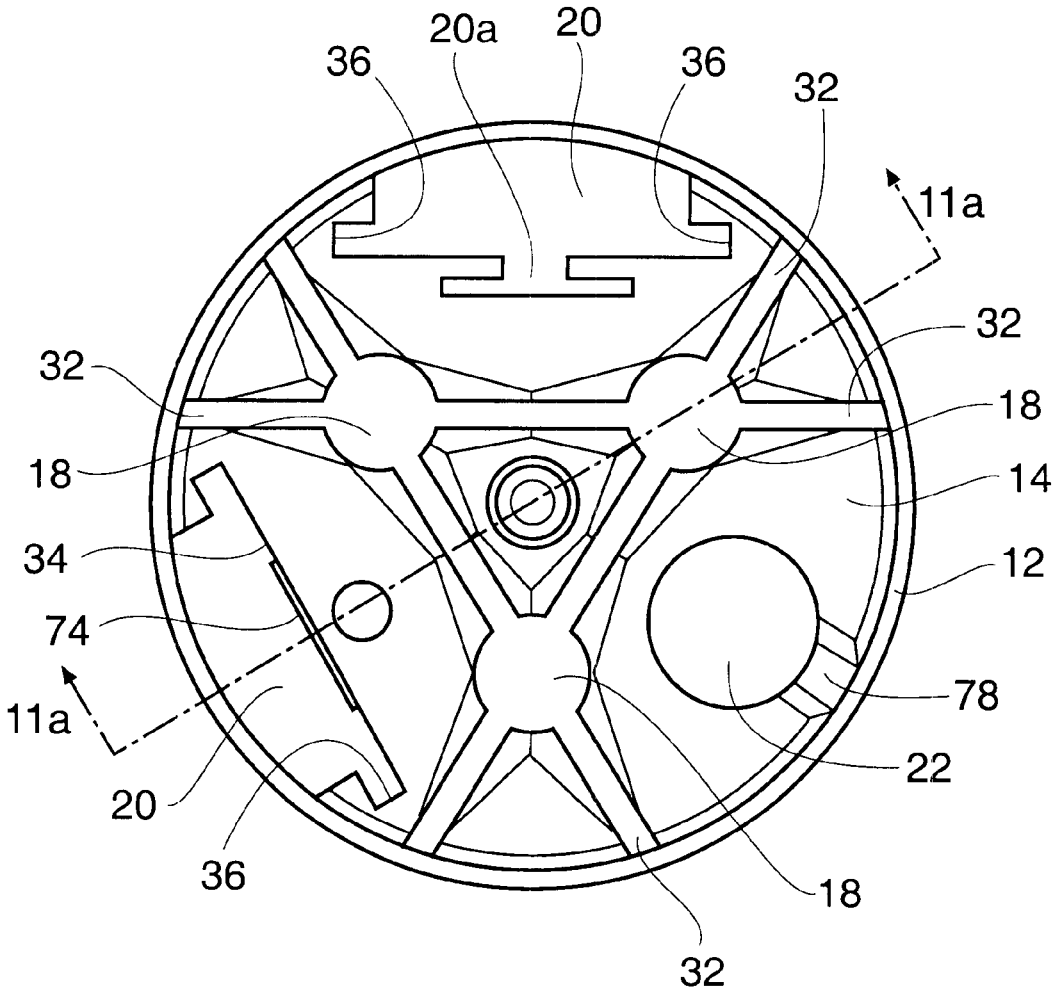
FIG. 10 is a top plan view of the dart carrier shown in FIG. 9 with the top removed.
Figure 11A:
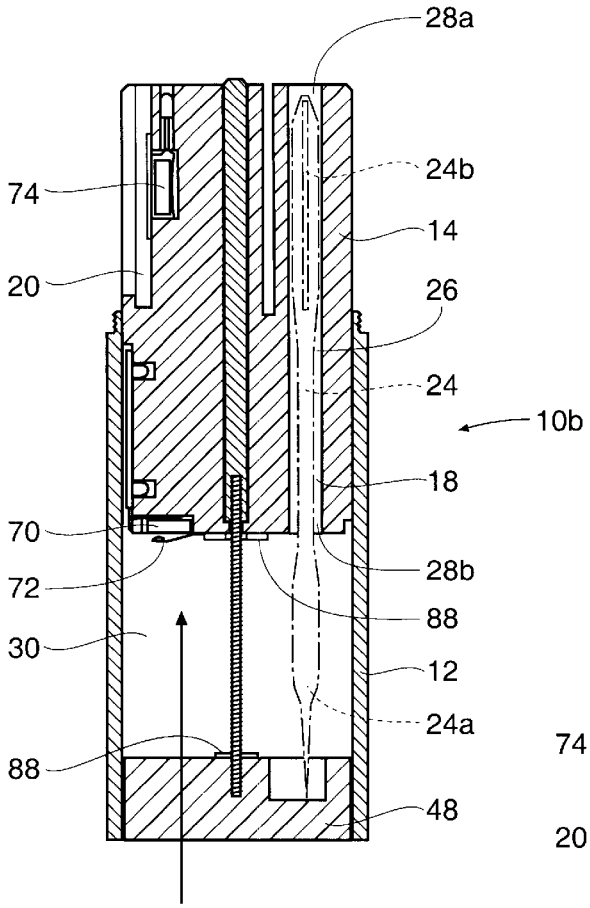
FIG. 11*a* is a longitudinal sectional view of the dart carrier shown in FIGS. 9 and 10, and taken along line 11*a*–11*a* of FIG. 10 showing the lifter plate in retracted, storage position.
Figure 11B:
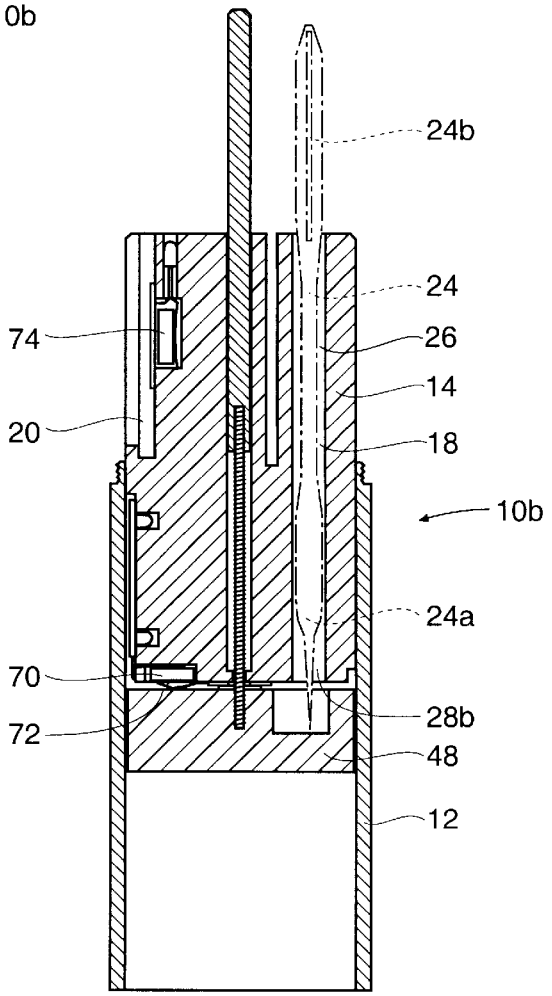
FIG. 11*b* is a longitudinal section view similar to the view of 11*a* but showing the lifter plate in the extended position.

As may be seen particularly in FIGS. 10, 11*a*, and 11*b*, through-chambers 18 are preferably cylindrical in shape and longitudinally coextensive with the quiver member 14. Assembled darts 24, shown in phantom in FIGS. 11*a* and 11*b*, are slidably received in individual through-chambers 18. As seen in the previous embodiments, the through-chambers 18 include a through bore 26, an open outer end 28*a* and an open inner end 28*b*. Individual assembled darts 24 to be stored in respective through-chambers 18 are inserted tip 24*a* first through open outer end 28*a*. The open inner end 28*b* allows the through-chamber bore 26 to be in communication with the housing bore 30. Through-chambers 18 are preferably further provided with communicating radially extending slots 32 to provide support and protection for the flights 24*b* of assembled darts 24 stored in the through-chambers 18.

Additional items, such as extra flights 24*a* or coins (not shown) may be stored in stationary, circumferentially-spaced recesses 20 located on the periphery of the quiver member 14. The recesses 20 preferably include a supporting surface 34 facing the exterior of the quiver member 14 and oppositely disposed, facing grooves 36 defining the width of the recess 20. The configuration of the recesses 20 is adapted to accommodate replaceable flight members 24*a* or coins (not shown). As seen particularly in FIG. 10, recesses 20 may be further provided with a secondary, countersunk recess 20*a*. Secondary recess 20*a* may be used for storage of additional items such as a dart wrench (not shown).

Figure 12:
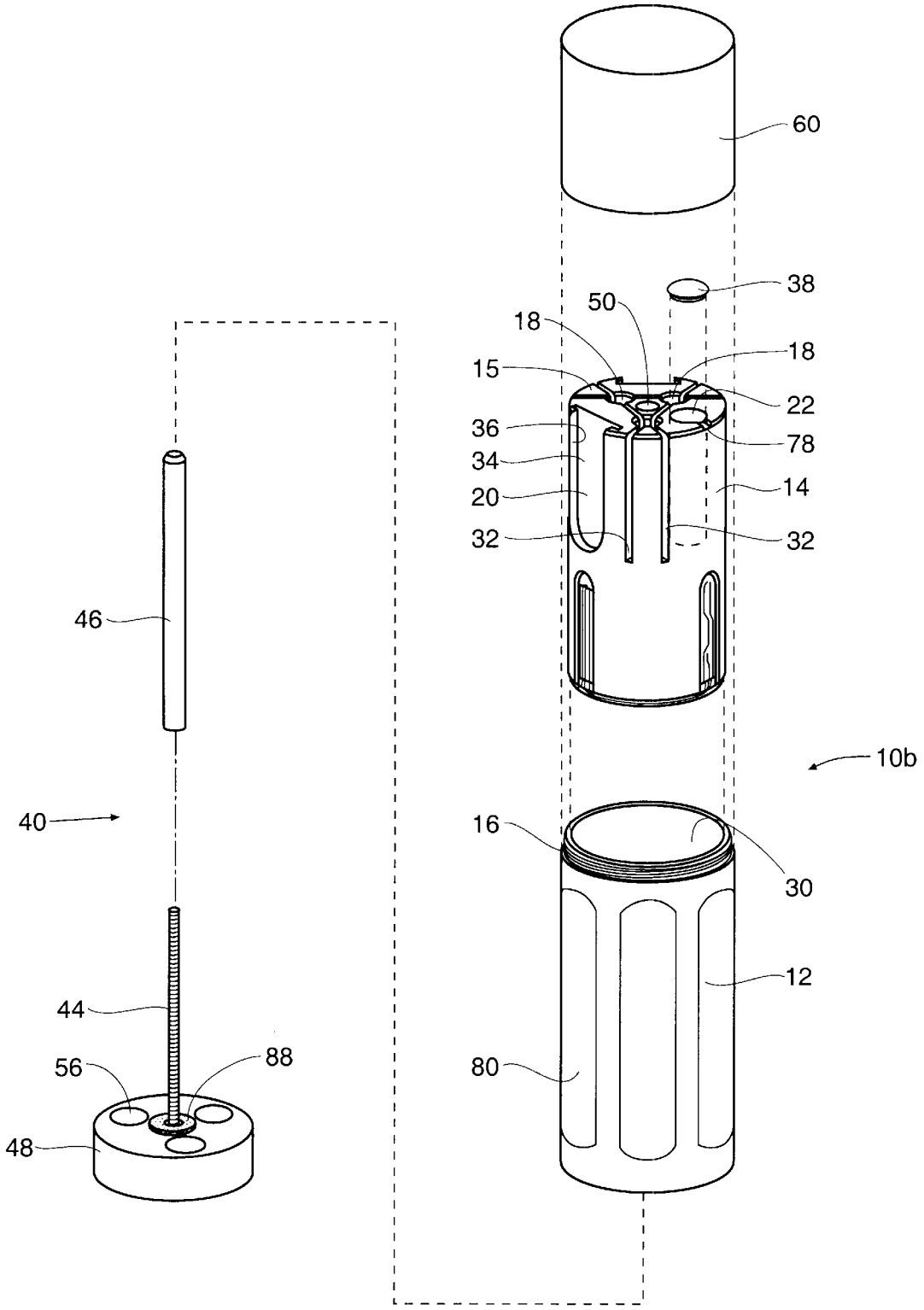
FIG. 12 is an exploded view of the components comprising the dart carrier shown in FIGS. 9–11*b*, inclusive.

As in the previous embodiments, the quiver member 14 preferably further includes at least one re-entrant bore 22 for slidably receiving and storing replacement dart tips 24*a*. The re-entrant bore 22 is preferably circumferentially-spaced and of a sufficient depth to accommodate a dart tip 24*a*. The re-entrant bore may further include a removable cap 38 as seen in FIG. 12. Cap 38 may be easily removed by inserting a fingernail (not shown), or other suitable tool into skived area 78 (see FIGS. 9 and 10).

As mentioned above, assembled darts 24 are preferably retained in through-chambers 18 located in the quiver member 14. Since the inner end 28*b* of each through-bore 26 is open and in communication with the hollow bore 30 of the housing 12, darts 24 stored in the through-chambers 18 may enter the hollow housing bore 30. Assembled darts 24 are preferably suspended on a longitudinally movable lifter 40 located in the housing bore 30 below the quiver member 14. As seen in FIGS. 11*a* and 11*b*, the lifter 40 functions similarly to the embodiment illustrated in FIGS. 3*a* and 3*b*. However it is to be noted that dart carrier 10*b* seen in FIGS. 11*a* and 11*b* is further fitted with an internal lighting source, such as a light emitting diode (LED) 70. LED 70 is activated by way of switch 72 upon contact with the lifter plate 48. The dart carrier 10*b* shown in FIGS. 9–12 may be further provided with a quiver light source 74. Light source 74 including a finger operable switch 76.

Figure 13:
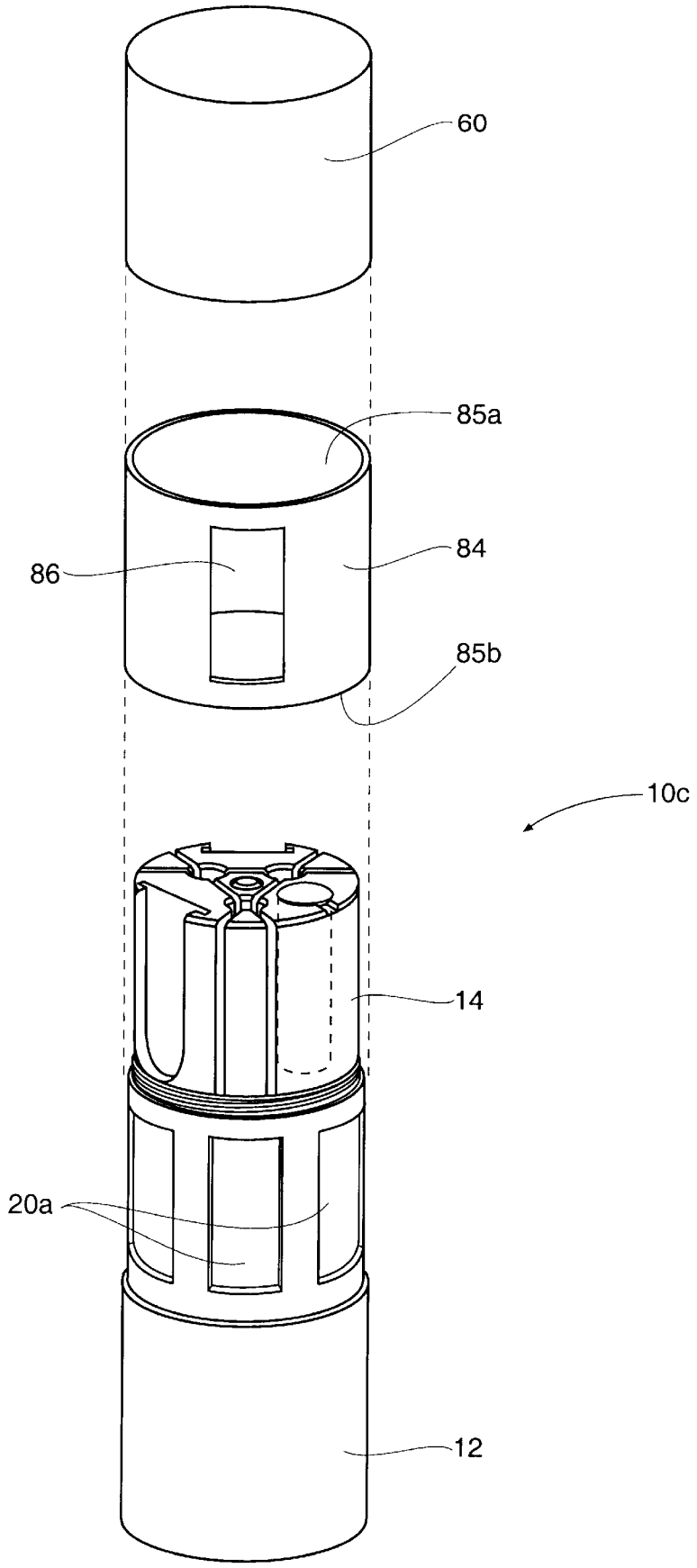
FIG. 13 is an exploded elevational view of another alternative embodiment dart carrier showing a rotatable collar member.

Referring now to FIG. 13, an alternative embodiment dart carrier 10*c* can be seen. The dart carrier 10*c* illustrated in this view, while similar to the previously mentioned embodiments, includes a rotatable collar member 84. Rotatable collar 84 includes open ends 85*a*, 85*b* and is adapted to be slidably received on housing member 12. The collar member 84 preferably includes at least one circumferentially spaced aperture or window 86. Dart carrier 10*c* is further provided with circumferentially spaced recesses 20*a* located on the outer periphery of the housing member 12 and arranged to provide additional storage space, if necessary. The rotatable collar member 84 provides alternative closure and access of the recesses 20*a* as rotation of the collar 84 moves the window 86 into and out of alignment with individual recesses 20*a*.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A dart carrier comprising:

a housing member having a tubular bore;

a lifter plate contained within said bore, said lifter plate including a longitudinally extending stem member;

said lifting plate and said stem member being arranged for predetermined longitudinal travel from a first rest position to a second extended position of said stem;

said carrier including a quiver member extending from an end of said housing member;

said quiver member including a throuborecommunicating with said tubular bore, said through bore arranged to slidably receive said stem member;

said quiver member including at least one dart-retaining chamber communicating with said tubular bore, said dart-retaining chamber extending longitudinally coextensive of said quiver member.

2. The dart carrier of claim 1 further including at least one re-entrant recess located in said quiver member.

3. The dart carrier of claim 1, wherein said quiver member further includes at least one re-entrant chamber for slidably receiving and accommodating a replaceable flight member.

4. The dart carrier of claim 3, wherein said re-entrant chamber is located on the periphery of said quiver member, said re-entrant chamber having a supporting surface facing the exterior of said quiver member and oppositely disposed facing grooves defining the width of said supporting surface.

5. The dart carrier of claim 1, wherein said housing contains a light source and a power source for said light source and switch means for controlling power to said light source, and wherein said quiver member is capable of transmitting light received from said light source.

6. The dart carrier of claim 5, wherein operation of said switch is controlled by longitudinal movement of said lifter plate.

7. The dart carrier of claim 1 wherein said second through bore includes a plurality of radially extending slots communicating with said through bore.

8. The dart carrier of claim 1 wherein said inner surface of said lifter plate includes at least one countersunk well area.

9. A dart carrier for transporting at least one dart assembly having a tip member and a replaceable flight member, said carrier comprising:

a housing member having a tubular bore;

a lifter plate slidably contained within said bore, said lifter plate having an inner surface and an outer surface and a stem member longitudinally extending inwardly from said inner surface;

said lifter plate and said stem member being arranged for predetermined longitudinal travel from a first rest position to a second extended position;

a quiver member residing in said tubular bore and extending outwardly from an end of said housing member;

said quiver member including first and second through bores each communicating with said housing tubular bore, said first through bore arranged to slidably receive said stem member, and said second through bore arranged to receive and accommodate said dart assembly, said inner surface of said lifter plate arranged for supporting engagement with said dart assembly; and stop means for restricting predetermined longitudinal travel of said lifter plate and said stem member.

10. The dart carrier of claim 9, wherein said quiver member further includes at least one re-entrant chamber for slidably receiving and accommodating a replaceable flight member.

11. The dart carrier of claim 10, wherein said re-entrant chamber is located on a peripheral portion of said quiver member, said re-entrant chamber having a supporting surface facing the exterior of said quiver member and oppositely disposed facing grooves defining the width of said supporting surface.

12. The dart carrier of claim 9, wherein said housing contains a light source and a power source for said light source and switch means for controlling power to said light source, and wherein said quiver member is capable of transmitting light therethrough received from said light source.

13. The dart carrier of claim 12, wherein operation of said switch is controlled by longitudinal movement of said lifter plate.

14. The dart carrier of claim 9 wherein said second through bore includes a plurality of radially extending slots communicating with said through bore.

15. The dart carrier of claim 9 wherein said inner surface of said lifter plate includes at least one countersunk well area.

* * * * *